US010281236B2

(12) United States Patent
Tang

(10) Patent No.: US 10,281,236 B2
(45) Date of Patent: May 7, 2019

(54) SIGHT

(71) Applicants: Sintai Optical (Shenzhen) Co., Ltd., ShenZhen, Guandong Province (CN); Asia Optical Co., Inc., Taichung (TW)

(72) Inventor: Chia-Chi Tang, Taichung (TW)

(73) Assignees: SINTAI OPTICAL (SHENZHEN) CO., LTD., Guandong Province (CN); ASIA OPTICAL CO., INC., Taichung (TW)

( * ) Notice: Subject to any disclaimer, the term of this patent is extended or adjusted under 35 U.S.C. 154(b) by 13 days.

(21) Appl. No.: 15/682,579

(22) Filed: Aug. 22, 2017

(65) Prior Publication Data

US 2018/0180382 A1 Jun. 28, 2018

(30) Foreign Application Priority Data

Dec. 27, 2016 (CN) ..... 2016 1 1227604

(51) Int. Cl.
*F41G 1/38* (2006.01)
*F41G 11/00* (2006.01)

(52) U.S. Cl.
CPC ..... *F41G 1/38* (2013.01); *F41G 11/003* (2013.01); *F41G 11/007* (2013.01)

(58) Field of Classification Search
CPC ..... F41G 1/38; G02B 23/00
USPC ..... 42/119, 122
See application file for complete search history.

(56) References Cited

U.S. PATENT DOCUMENTS 9,798,156 B2 * 10/2017 Chang ..... G02B 27/36

* cited by examiner

*Primary Examiner* — J. Woodrow Eldred
(74) *Attorney, Agent, or Firm* — McClure, Qualey & Rodack, LLP

(57) ABSTRACT

A sight includes a main body, an erecting unit, and a first adjusting element. The erecting unit includes a second magnetically attractable element and movably disposed within the main body. The first adjusting element includes a first magnetically attractable element and is movably disposed on the main body. The first adjusting element extends into the main body and against the erecting unit. The first magnetically attractable element attracts the second magnetically attractable element so that the first adjusting element contacts the erecting unit. The first adjusting element is rotatable to move the erecting unit in a first direction.

18 Claims, 6 Drawing Sheets

200

200

200

SIGHT

BACKGROUND OF THE INVENTION

Field of the Invention

The invention relates to a sight, and more particularly to a sight including magnetically attractable elements respectively disposed in adjusting elements and an erecting unit, so that the adjusting elements can tightly contact the erecting unit.

Description of the Related Art

Referring to FIGS. 1A and 1B, a conventional sight 100 includes a main body 10, an elevation adjusting element 20, a windage adjusting element 30, an erecting unit 15 and an elastic element 25. Both the elevation adjusting element 20 and the windage adjusting element 30 are mounted on the main body 10. The elevation adjusting element 20 extends into the main body 10 and has a first front end 22 placed against the erecting unit 15. Also, the windage adjusting element 30 extends into the main body 10 and has a second front end 33 placed against the erecting unit 15. The elastic element 25 is disposed within the main body 10 and against the erecting unit 15.

During adjustment of bullet impact points, the elevation adjusting element 20 and/or the windage adjusting element 30 is rotated so that the first front end 22 and/or the second front end 33 moves the erecting unit 15 in a first direction. The elastic element 25 is deformed to generate an elastic force as the erecting unit 15 is moved. The elastic force is configured to resist against the movement of the erecting unit 15 in a second direction opposite to the first direction, so that the erecting unit 15 keeps contacting the first front end 22 and the second front end 33. Such arrangement sustains the operational reliability of the elevation adjusting element 20 or the windage adjusting element 30. In addition, the sight 100 includes a reticle which is moved as the erecting unit 15 is moved. The reticle is able to provide a positioning reference for the user during the adjustment of the bullet impact point.

In the structure described above, if the range of the adjustment of bullet impact points is large, then the movement of the erecting unit 15 is wide and the elastic element 25 is susceptible to elastic fatigue. The elevation adjusting element 20 and the windage adjusting element 30 may be unable to keep contacting the erecting unit 15 due to the elastic fatigue of the elastic element 25. As a result, the maximum adjusting amount of the sight 100 cannot be reached in practice, the movement of the reticle by operating the elevation adjusting element 20 or the windage adjusting element 30 may fail, the trace of the reticle may be not a straight line, the reticle may jitter irregularly, and other problems may also occur. All the problems described cause the error of the adjustment of bullet impact points.

BRIEF SUMMARY OF THE INVENTION

The invention provides a sight including a plurality of magnetically attractable elements respectively disposed in adjusting elements and an erecting unit. The magnetic force generated between the magnetically attractable elements is configured to substitute for the decreased supporting force (elastic force) due to the elastic fatigue of the elastic element, so that the adjusting elements can keep contacting the erecting unit.

The sight in accordance with an embodiment of the invention includes a main body, an erecting unit, and a first adjusting element. The erecting unit includes a second magnetically attractable element and movably disposed within the main body. The first adjusting element includes a first magnetically attractable element and is movably disposed on the main body. The first adjusting element extends into the main body and against the erecting unit. The first magnetically attractable element attracts the second magnetically attractable element so that the first adjusting element contacts the erecting unit. The first adjusting element is rotatable to move the erecting unit in a first direction.

In another embodiment, the sight further includes a second adjusting element which is movably disposed on the main body and includes a third magnetically attractable element. The second adjusting element extends into the main body and against the erecting unit. The third magnetically attractable element attracts the second magnetically attractable element so that the second adjusting element contacts the erecting unit. The second adjusting element is rotatable to move the erecting unit in a second direction.

In yet another embodiment, the second direction is a horizontal direction.

In another embodiment, the second adjusting element further includes a second ferromagnetic adapter covering the third magnetically attractable element and is placed against the erecting unit.

In yet another embodiment, an axis of the erecting unit is moved toward the first adjusting element or the second adjusting element at an angle when the erecting unit is moved toward the first adjusting element or the second adjusting element at the angle.

In another embodiment, the sight further includes an elastic element disposed within the main body and against the erecting unit.

In yet another embodiment, the second magnetically attractable element and the third magnetically attractable element are two magnetic elements.

In another embodiment, the magnetic elements are Alnico magnet (AlNiCo), Neodymium magnet ($Nd_2Fe_{14}B$) or Samarium-cobalt magnet ($SmCo_5$).

In yet another embodiment, the second magnetically attractable element and the third magnetically attractable element are a magnetic element and a ferromagnetic element.

In another embodiment, the magnetic element is Alnico magnet (AlNiCo), Neodymium magnet ($Nd_2Fe_{14}B$) or Samarium-cobalt magnet ($SmCo_5$).

In yet another embodiment, the first direction is a vertical direction.

In another embodiment, the first adjusting element further includes a first ferromagnetic adapter covering the first magnetically attractable element and is placed against the erecting unit.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

Figure 1A:
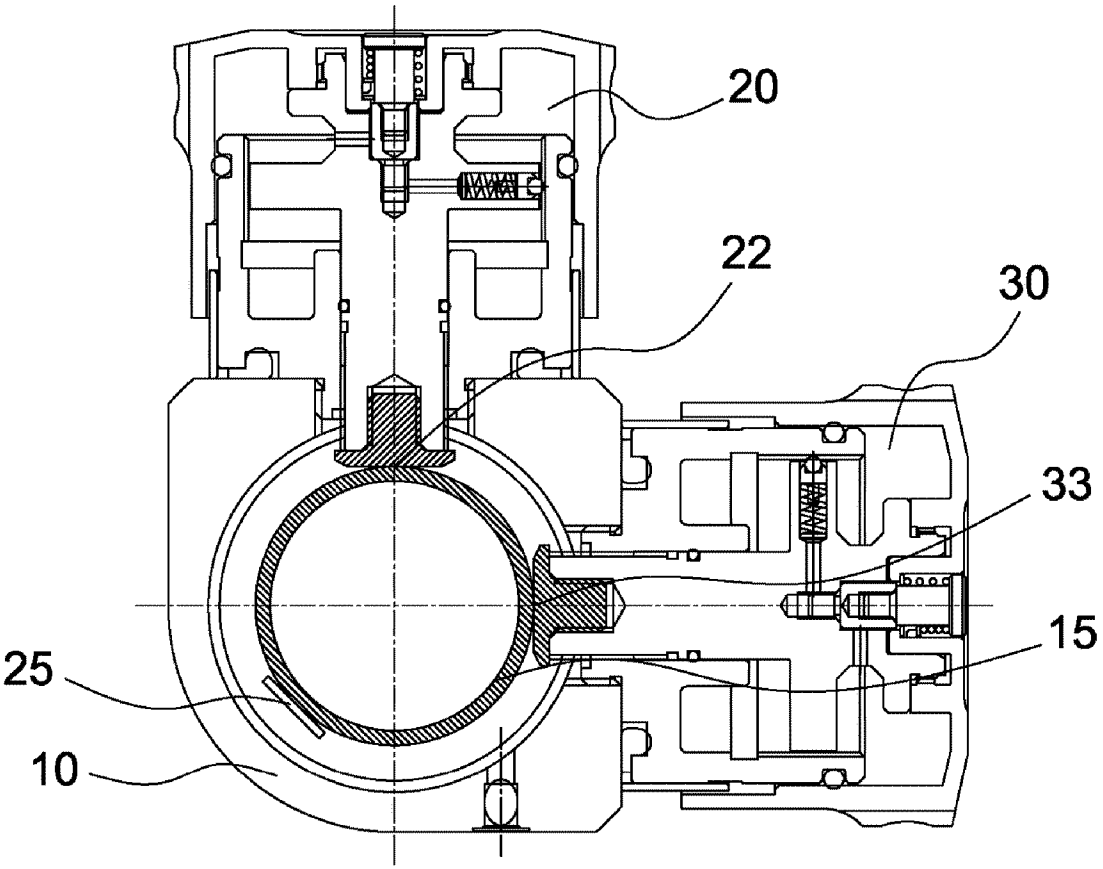
Fig.1A (PRIOR ART)
FIG. 1A is a front sectional view of a prior sight.
Figure 1B:
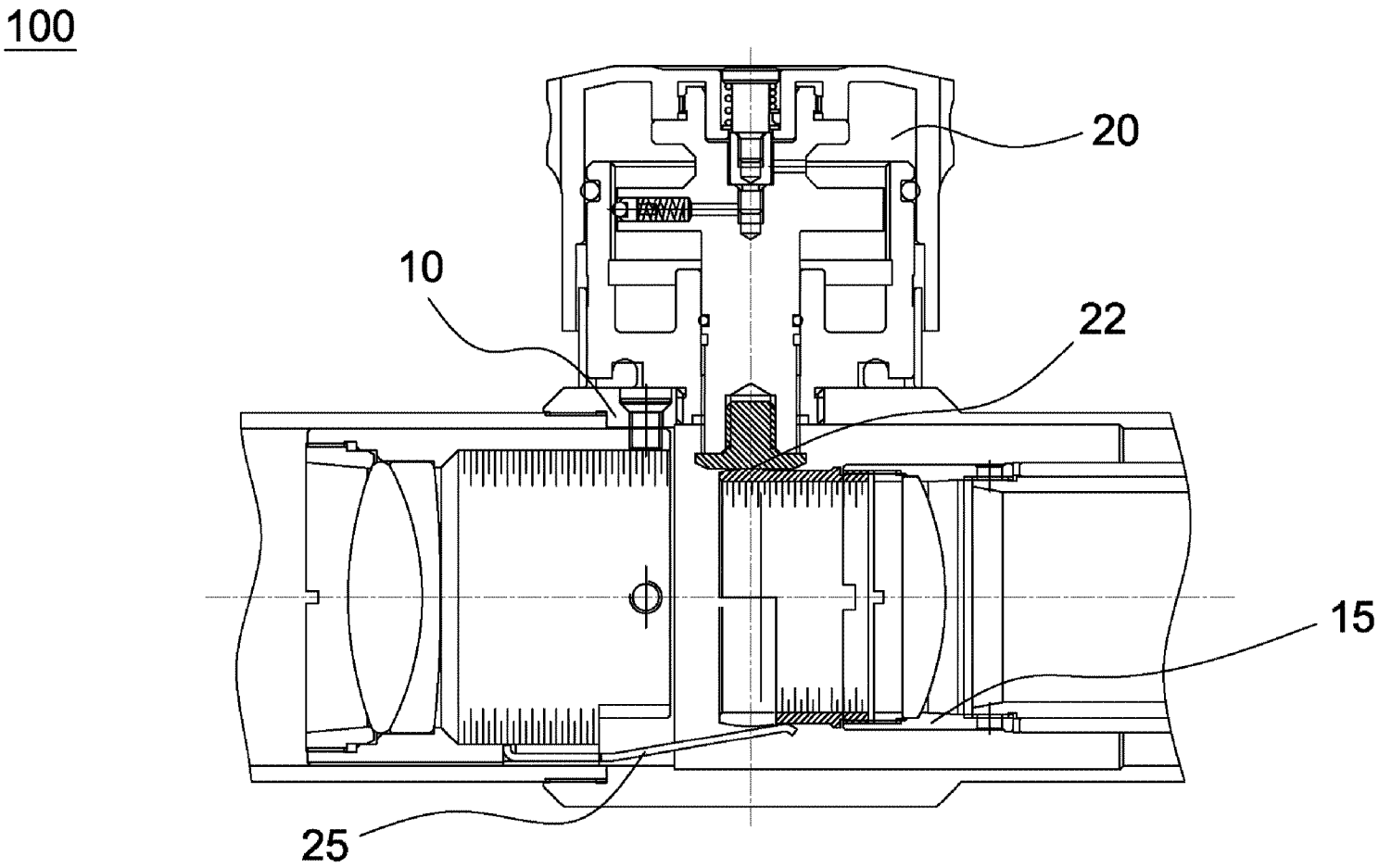
Fig.1B (PRIOR ART)
FIG. 1B is a side sectional view of a prior sight.
Figure 2:
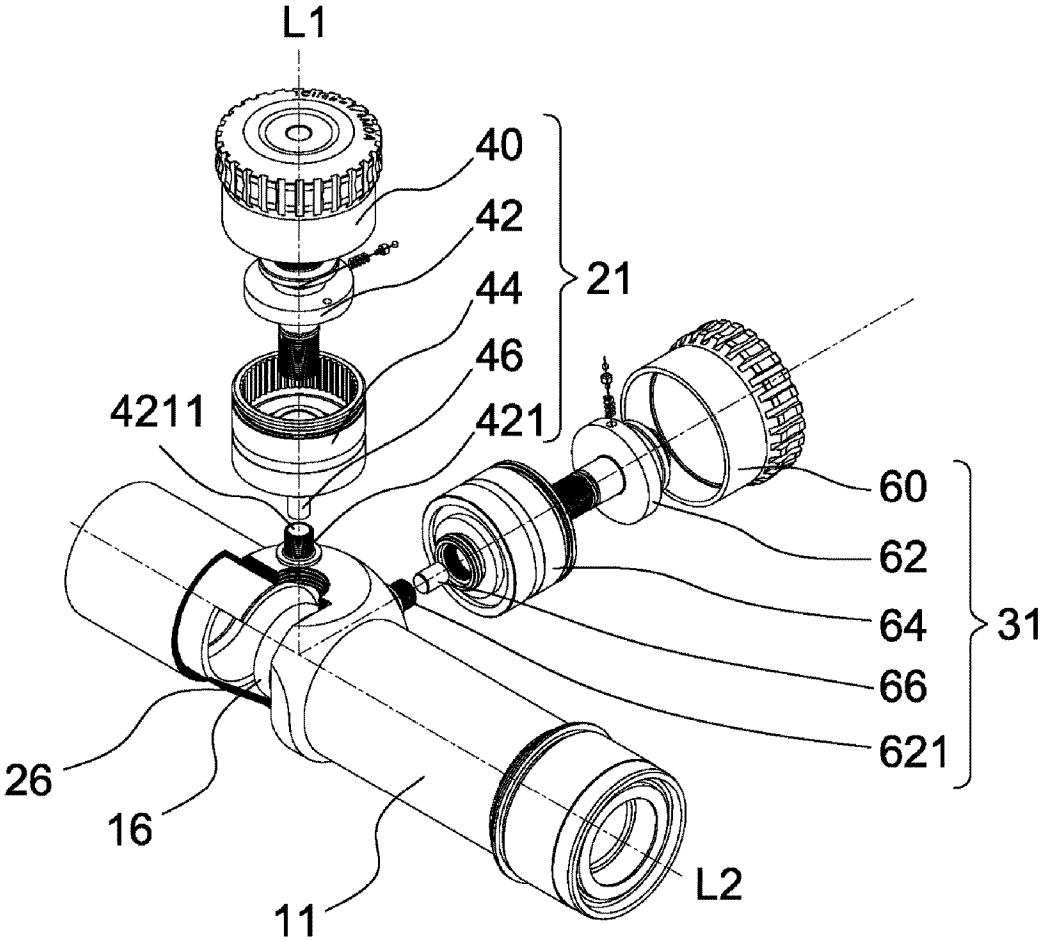
FIG. 2 is an exploded view of a sight in accordance with an embodiment of the invention.
Figure 3A:
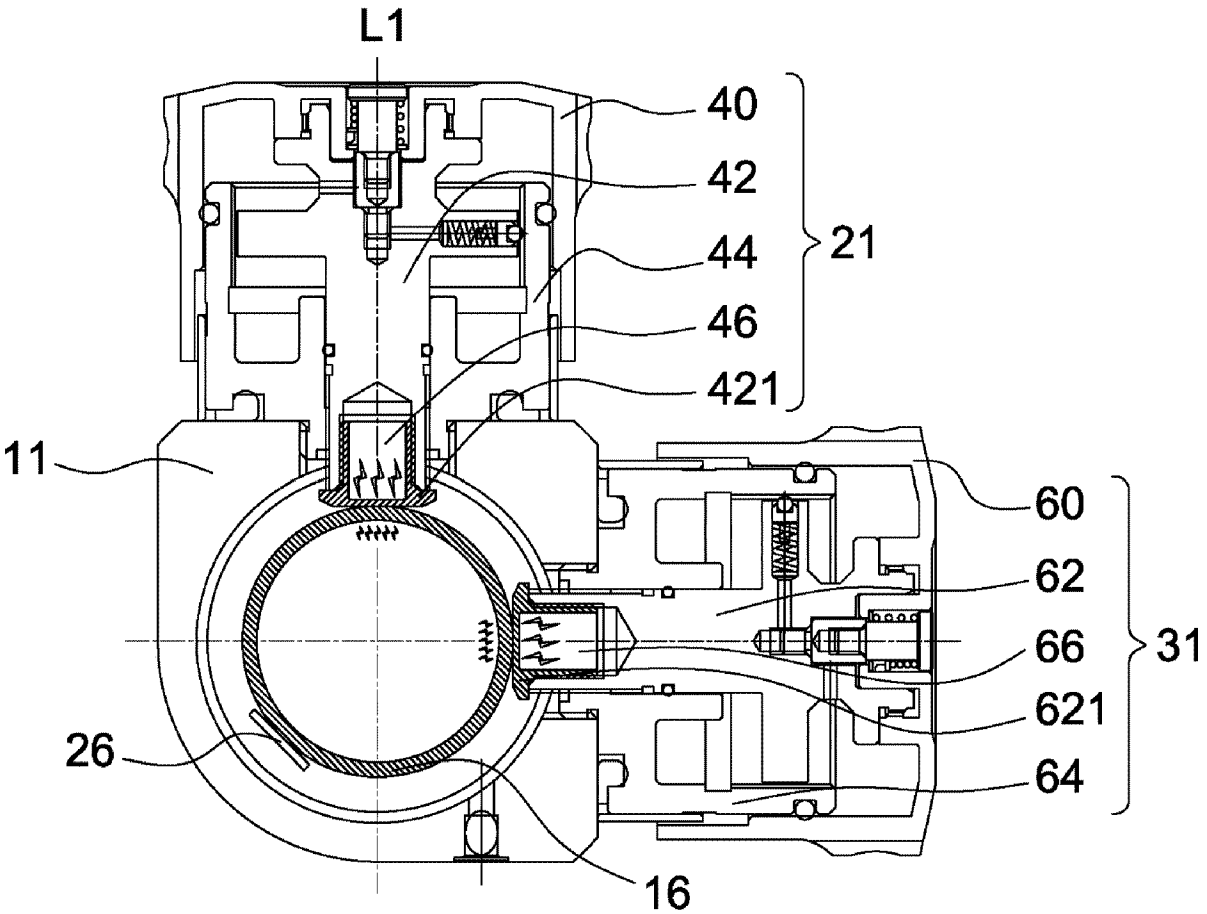
FIG. 3A is a front sectional view of the sight of the FIG. 2.
Figure 3B:
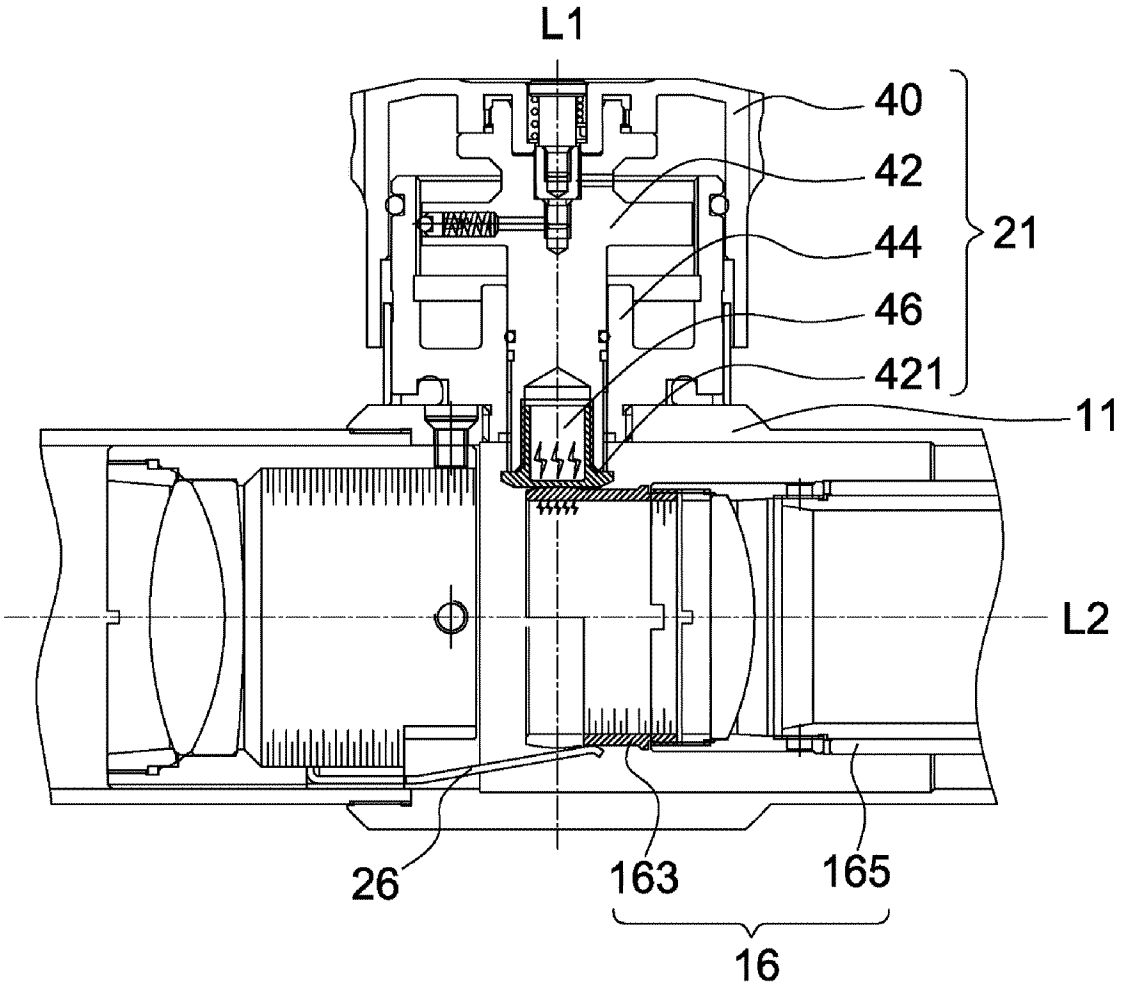
FIG. 3B is a side sectional view of the sight of the FIG. 2.

Referring to FIGS. 2, 3A and 3B, a sight 200 in accordance with a first embodiment of the invention includes a main body 11, a first adjusting element 21, a second adjusting element 31, an erecting unit 16 and an elastic element 26. Both the first adjusting element 21 and the second adjusting element 31 are in contact with the erecting unit 16. During the adjustment of bullet impact points, the first adjusting element 21 and the second adjusting element 31 are rotated to push or move the erecting unit 16 in a direction (e.g. upward, downward, leftward, rightward).

The erecting unit 16 includes a second magnetically attractable element 163 and an erecting cylinder 165. The second magnetically attractable element 163 is connected to a front end of the erecting cylinder 165. The elastic element 26 is disposed within the main body 11 and against the second magnetically attractable element 163. The elastic element 26 is, for example, a flat spring. The described "magnetically attractable element" may be a magnetic element, or an element which can be attracted by a magnetic element. The element which can be attracted by a magnetic element may be but not limited to a ferromagnetic element.

The first adjusting element 21 includes a first knob 40, a first screw 42, a first nut 44, a first magnetically attractable element 46 and a first ferromagnetic adapter 421. The first nut 44 is fixed on the main body 11 and has first inner threads. The first screw 42 fits in the first nut 44 through the first inner threads. The first knob 40 is connected to the first screw 42 so that the first screw 42 can be rotated along with the first knob 40. Referring to FIG. 2, the first magnetically attractable element 46 is disposed in a hole 4211 of the first ferromagnetic adapter 421, and the first ferromagnetic adapter 421 is disposed at a front end of the first screw 42. The first screw 42, the first magnetically attractable element 46 and the first ferromagnetic adapter 421 are combined into an assembly, with the first ferromagnetic adapter 421 placed against the second magnetically attractable element 163.

The second adjusting element 31 includes a second knob 60, a second screw 62, a second nut 64, a third magnetically attractable element 66 and a second ferromagnetic adapter 621. The second nut 64 is fixed on the main body 11 and has second inner threads. The second screw 62 fits in the second nut 64 through the second inner threads. The second knob 60 is connected to the second screw 62 so that the second screw 62 can be rotated along with the second knob 60. Referring to FIG. 2, the third magnetically attractable element 66 is disposed in a hole (not shown) of the second ferromagnetic adapter 621, and the second ferromagnetic adapter 621 is disposed at a front end of the second screw 62. The second screw 62, the third magnetically attractable element 66 and the second ferromagnetic adapter 621 are combined into an assembly, with the second ferromagnetic adapter 621 placed against the second magnetically attractable element 163.

In present embodiment, both the first magnetically attractable element 46 and the third magnetically attractable element 66 are magnetic elements, and the magnetic element may be Alnico magnet (AlNiCo), Neodymium magnet ($Nd_2Fe_{14}B$), Samarium-cobalt magnet ($SmCo_5$), or other permanent magnets. The second magnetically attractable element 163 is a ferromagnetic element. The first magnetically attractable element 46 is able to attract the second magnetically attractable element 163 through the first ferromagnetic adapter 421, and the third magnetically attractable element 66 is able to attract the second magnetically attractable element 163 through the second ferromagnetic adapter 621. By this arrangement, the first adjusting element 21 and the second adjusting element 31 are kept in tight contact with the erecting unit 16.

Figure 4:
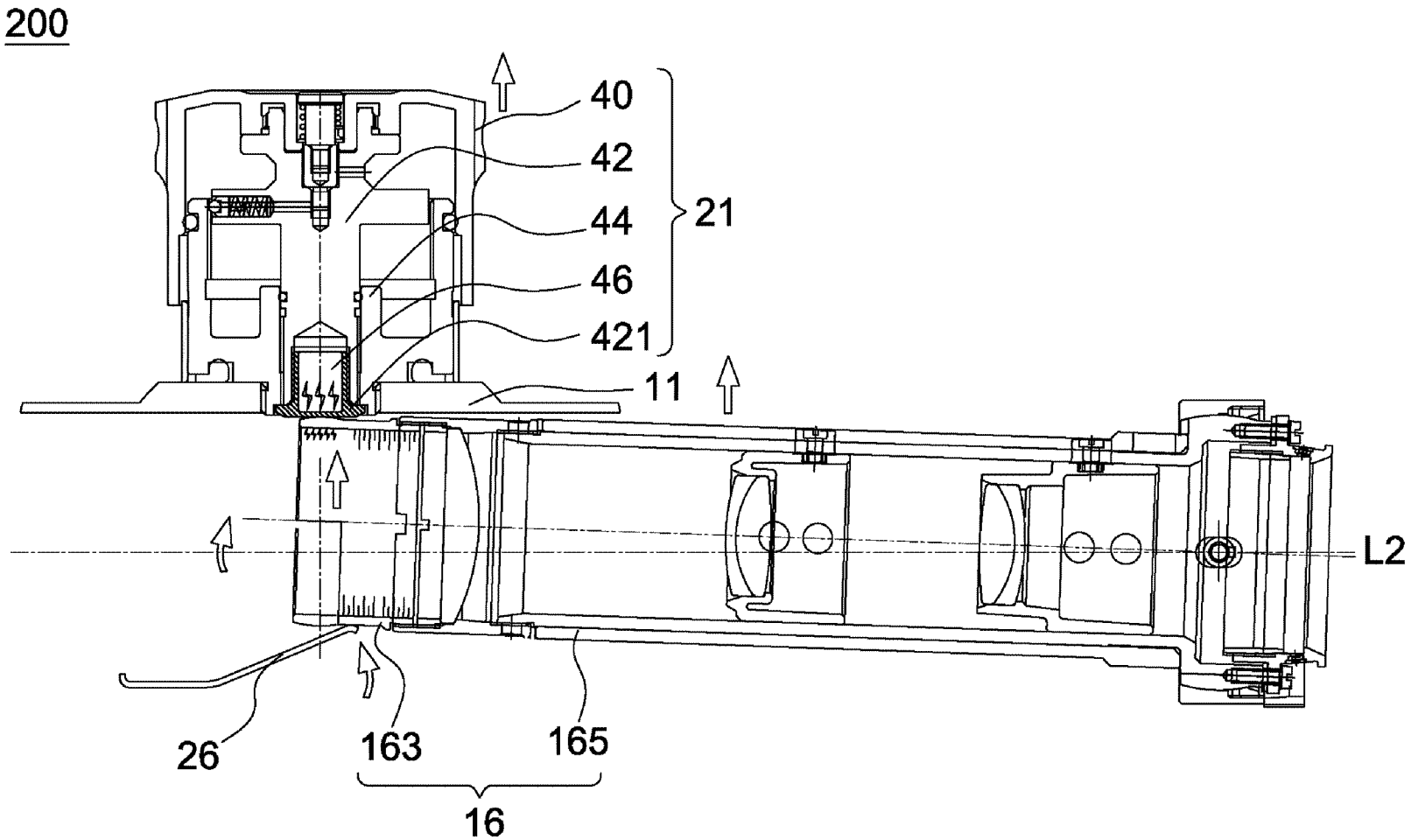
FIG. 4 depicts the sight of the FIG. 2 during adjustment of bullet impact points.

As shown in FIG. 4, during the adjustment of bullet impact points, the first knob 40 is rotated to move the first screw 42 relative to the first nut 44 in a first direction, so that the first ferromagnetic adapter 421 moves the erecting unit 16 in the first direction. The second knob 60 is rotated to move the second screw 62 relative to the second nut 64 in a second direction, so that the second ferromagnetic adapter 621 moves the erecting unit 16 in the second direction. Meanwhile, the elastic element 26 resists or supports the movement of the erecting unit 16 so that the first adjusting element 21 and the second adjusting element 31 continuously contact the erecting unit 16 during the movement. In present embodiment, the first direction is a vertical direction, and the second direction is a horizontal direction.

It is worth noting that when the elastic element 26 fails to provide a sufficient support for the erecting unit 16 due to elastic fatigue, both the first adjusting element 21 and the second adjusting element 31 are still able to contact the erecting unit 16 since both the first magnetically attractable element 46 and the third magnetically attractable element 66 attract the second magnetically attractable element 163. For example, an axis L2 of the erecting unit 16 is originally horizontal (FIG. 3B) and it is desired that the erecting unit 16 is moved toward the first adjusting element 21 at a first angle by operation of the first adjusting element 21 (FIG. 4). Due to elastic fatigue, the elastic element 26 fails to provide a sufficient support for the erecting unit 16 to reach the first angle. However, since both the first magnetically attractable element 46 and the third magnetically attractable element 66 attract the second magnetically attractable element 163, the erecting unit 16 is still moved toward the first adjusting element 21 at the first angle. That is, the axis L2 of the erecting unit 16 is moved toward the first adjusting element 21 at the first angle. Therefore, the erecting unit 16 is always kept in tight contact with the first adjusting element 21 during operation of the first adjusting element 21. Similarly, when elastic fatigue of the elastic element 26 occurs and moving the erecting unit 16 toward the second adjusting element 31 at a second angle is desired, the axis L2 of the erecting unit 16 can be moved toward the second adjusting element 31 at the second angle since both the first magnetically attractable element 46 and the third magnetically attractable element 66 attract the second magnetically attractable element 163. Therefore, the erecting unit 16 is always kept in tight contact with the second adjusting element 31. In present embodiment, the first angle and the second angle range from −5 to 5 degrees.

In a second embodiment, both the first magnetically attractable element 46 and the third magnetically attractable element 66 are ferromagnetic elements. The second magnetically attractable element 163 is a magnetic element, and the magnetic element is Alnico magnet (AlNiCo), Neodymium magnet ($Nd_2Fe_{14}B$), Samarium-cobalt magnet ($SmCo_5$) or other permanent magnets. In such arrangement, the first magnetically attractable element 46 and the first ferromagnetic adapter 421 are integrally formed to be a single ferromagnetic element, are disposed at the front end of the first screw 42, and attract the second magnetically attractable element 163. The third magnetically attractable element 66 and the second ferromagnetic adapter 621 are also integrally formed to be another single ferromagnetic element, are disposed at the front end of the second screw 62, and attract the second magnetically attractable element 163. Therefore, the first adjusting element 21 and the second adjusting element 31 are always kept in tight contact with the erecting unit 16. The arrangement of other elements and operation of adjustment of bullet impact points of the second embodiment are similar to those of the first embodiment, and therefore the descriptions thereof are omitted.

In a third embodiment, both the first magnetically attractable element 46 and the third magnetically attractable element 66 are magnetic elements having a first polarity, and the second magnetically attractable element 163 is a magnetic element having a second polarity. The first polarity is opposite to the second polarity. The magnetic elements may be Alnico magnet (AlNiCo), Neodymium magnet ($Nd_2Fe_{14}B$), Samarium-cobalt magnet ($SmCo_5$) or other permanent magnets. Since the first polarity is opposite to the second polarity, both the first magnetically attractable element 46 and the third magnetically attractable element 66 are able to attract the second magnetically attractable element 163, so that the first adjusting element 21 and the second adjusting element 31 are always kept in tight contact with the erecting unit 16. The arrangement of other elements and operation of adjustment of bullet impact points of the third embodiment are similar to those of the above embodiments, and therefore the descriptions thereof are omitted.

In the embodiments described above, it is understood that a plurality of ferromagnetic elements (not shown) can be additionally provided between the first adapter 421 and the second magnetically attractable element 163 and between the second adapter 621 and the second magnetically attractable element 163 if the first adapter 421 and the second adapter 621 are not made of ferromagnetic materials. In other words, the surfaces of the first adjusting element 21 and second adjusting element 31 in contact with the erecting unit 16 can be made of magnetically attractable material. Alternatively, the ferromagnetic elements described above can be additionally provided when the first adapter 421 and the second adapter 621 are not made of ferromagnetic materials. In either way, both the first adjusting element 21 and the second adjusting element 31 are always kept in tight contact with the erecting unit 16.

In the sight 200 of the invention, the first magnetically attractable element 46 in the first adjusting element 21 and the third magnetically attractable element 66 in the second adjusting element 31 are provided to attract the second magnetically attractable element 163 in the erecting unit 16, so that the erecting unit 16 is always kept in tight contact with the first adjusting element 21 and the second adjusting element 31, and the erecting unit 16 can be positively moved by operation of the first adjusting element 21 and the second adjusting element 31. During the adjustment of bullet impact points, therefore, the probably problems caused by the elastic fatigue of the elastic element 26 can be avoided, the error of the adjustment of bullet impact points of the sight 200 can be eliminated, and the maximum adjusting amount of the sight 200 can be practically reached.

What is claimed is:

1. A sight, comprising:

a main body;

an erecting unit comprising a second magnetically attractable element and movably disposed within the main body; and a first adjusting element comprising a first magnetically attractable element and movably disposed on the main body;

wherein the first adjusting element extends into the main body and against the erecting unit;

wherein the first magnetically attractable element attracts the second magnetically attractable element so that the first adjusting element contacts the erecting unit;

wherein the first adjusting element is rotatable to move the erecting unit in a first direction.

2. The sight as claimed in claim 1, further comprising an elastic element which is disposed within the main body and against the erecting unit.

3. The sight as claimed in claim 1, wherein the first magnetically attractable element and the second magnetically attractable element are two magnetic elements.

4. The sight as claimed in claim 3, wherein each of the magnetic elements is selected from the group consisting of Alnico magnet (AlNiCo), Neodymium magnet (Nd2Fe14B) and Samarium-cobalt magnet (SmCo5).

5. The sight as claimed in claim 1, wherein the first magnetically attractable element and the second magnetically attractable element are a magnetic element and a ferromagnetic element;

wherein the first magnetically attractable element is a ferromagnetic element when the second magnetically attractable element is magnetic element;

wherein the first magnetically attractable element is a magnetic element when the second magnetically attractable element is a ferromagnetic element.

6. The sight as claimed in claim 5, wherein the magnetic element is selected from the group consisting of Alnico magnet (AlNiCo), Neodymium magnet (Nd2Fe14B) and Samarium-cobalt magnet (SmCo5).

7. The sight as claimed in claim 1, wherein the first direction is a vertical direction.

8. The sight as claimed in claim 1, wherein the first adjusting element further comprises a first ferromagnetic adapter which covers the first magnetically attractable element and is placed against the erecting unit.

9. The sight as claimed in claim 1, further comprising a second adjusting element which is movably disposed on the main body and comprises a third magnetically attractable element;

wherein the second adjusting element extends into the main body and against the erecting unit;

Wherein the third magnetically attractable element attracts the second magnetically attractable element so that the second adjusting element contacts the erecting unit;

wherein the second adjusting element is rotatable to move the erecting unit in a second direction.

10. The sight as claimed in claim 9, wherein the second direction is a horizontal direction.

11. The sight as claimed in claim 9, wherein the second adjusting element further comprises a second ferromagnetic adapter which covers the third magnetically attractable element and is placed against the erecting unit.

12. The sight as claimed in claim 9, wherein an axis of the erecting unit is moved toward the first adjusting element or the second adjusting element at an angle when the erecting unit is moved toward the first adjusting element or the second adjusting element at the angle.

13. The sight as claimed in claim 9, further comprising an elastic element which is disposed within the main body and against the erecting unit.

14. The sight as claimed in claim 9, wherein the second magnetically attractable element and the third magnetically attractable element are two magnetic elements.

15. The sight as claimed in claim 14, wherein each of the magnetic elements is selected from the group consisting of Alnico magnet (AlNiCo), Neodymium magnet (Nd2Fe14B) and Samarium-cobalt magnet (SmCo5).

16. The sight as claimed in claim 9, wherein the second magnetically attractable element and the third magnetically attractable element are a magnetic element and a ferromagnetic element;

wherein the first magnetically attractable element is a ferromagnetic element when the second magnetically attractable element is a magnetic element;

wherein the first magnetically attractable element is a magnetic element when the second magnetically attractable element is a ferromagnetic element.

17. The sight as claimed in claim 16, wherein the magnetic element is selected from the group consisting of Alnico magnet (AlNiCo), Neodymium magnet (Nd2Fe14B) and Samarium-cobalt magnet (SmCo5).

18. A sight, comprising:

a main body;

an erecting unit comprising a second magnetically attractable element and movably disposed within the main body; and a first adjusting element comprising a first screw having a front end penetrating into the main body and a first magnetically attractable element disposed at the front of the first screw and movably disposed on the main body;

wherein the first adjusting element extends into the main body and against the erecting unit;

wherein the first magnetically attractable element attracts the second magnetically attractable element so that the first adjusting element contacts the erecting unit;

wherein the first adjusting element is rotatable to move the erecting unit in a first direction.

* * * * *